US007658638B2

(12) United States Patent
Motojima

(10) Patent No.: US 7,658,638 B2
(45) Date of Patent: Feb. 9, 2010

(54) CONNECTOR

(75) Inventor: Joe Motojima, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/265,776

(22) Filed: Nov. 6, 2008

(65) Prior Publication Data

US 2009/0142949 A1 Jun. 4, 2009

(51) Int. Cl.
*H01R 13/62* (2006.01)

(52) U.S. Cl. ..... 439/377; 439/159; 439/630

(58) Field of Classification Search ..... 439/377, 439/159, 630, 374
See application file for complete search history.

(56) References Cited

U.S. PATENT DOCUMENTS 6,783,384 B2 * 8/2004 Wu ..... 439/377
2001/0003074 A1 * 6/2001 Johnson et al. ..... 439/377
2001/0005644 A1 * 6/2001 Hashimoto ..... 439/159
2007/0155244 A1 * 7/2007 Lai et al. ..... 439/630

FOREIGN PATENT DOCUMENTS

JP 2003-217738 A 7/2003

* cited by examiner

*Primary Examiner*—Gary F. Paumen
(74) *Attorney, Agent, or Firm*—Frishauf, Holtz, Goodman & Chick, P.C.

(57) ABSTRACT

A connector capable of preventing an engaging portion of an ejection mechanism from being damaged even when a card-type electronic component is inserted obliquely with respect to a card inserting/ejecting direction. A cover is mounted on a housing having a card accommodating portion for accommodating a memory card in a manner covering the card accommodating portion. The ejection mechanism ejects the memory card from the card accommodating portion. The ejection mechanism has a locking portion that is engaged with the memory card such that part of the memory card remains within the card accommodating portion during ejection of the memory card. The cover is provided with a guide for guiding a front end of the memory card in the card inserting/ejecting direction when the memory card is inserted into the card accommodating portion obliquely with respect to the card inserting/ejecting direction C.

2 Claims, 9 Drawing Sheets

CONNECTOR

BACKGROUND OF THE INVENTION

1. Field of the Invention

This invention relates to a connector, and more particularly to a connector for a card-type electronic component, such as a memory card.

2. Description of the Related Art

Conventionally, there has been proposed a card connector including a housing and an ejection mechanism (see Japanese Laid-Open Patent Publication (Kokai) No. 2003-217738.

The housing has an upper half portion and a lower half portion. The upper half portion and the lower half portion are connected to thereby form an accommodating space for accommodating a card.

The ejection mechanism ejects the card accommodated in the accommodating space. The ejection mechanism is comprised of an ejection plate, a tension spring, a rod, a heart cam, and a leaf spring.

The ejection plate has a front end formed with an engaging portion. The rear end of the ejection plate is formed with a pressing portion. The ejection plate is accommodated in the accommodating space, and is supported by the housing in a manner movable in directions in which the card is inserted into and ejected from the accommodating space. The card inserted into the accommodating space is brought into abutment with the pressing portion for engagement with the same. At this time, the engaging portion is engaged with a cutout formed in a side surface of the card, for engagement with the card.

The tension spring has one end fixed to the housing. The other end of the tension spring is connected to a connecting portion of the ejection plate. Thus, the ejection plate is urged in the ejecting direction of the card.

The rod has opposite ends each bent into an L-shape. One end of the rod is connected to the connecting portion of the ejection plate, and the other end thereof is inserted into a cam groove of the heart cam, described hereinafter.

The heart cam has the cam groove having a heart-like shape, and is formed in the lower half portion of the housing. The engagement between the cam groove of the heart cam and the other end of the rod causes the card to be locked or ejected whenever a card inserted into the accommodating space of the housing is pushed in the inserting direction of the card.

When no card is inserted into the accommodating space of the housing, the ejection plate is positioned at the foremost part of the accommodating space (toward the opening of the accommodating space). At this time, the other end of the rod is positioned at a first bent point (position corresponding to a lower end of a heart-like shape) of the cam groove.

When a card is inserted into the accommodating space, the front end of the card is brought into abutment with the pressing portion of the ejection plate, and the engaging portion of the ejection plate is engaged with the cutout of the card, whereafter the ejection plate is moved together with the card.

When the card advances by a predetermined distance in the accommodating space, the other end of the rod is brought into abutment with a second bent point (position corresponding to a right upper end of the heart-like shape) of the cam groove. At this time, the ejection plate is positioned at the rearmost part of the accommodating space, and even if the card is further pushed, it is not moved.

When a user's hand is taken off the card, the ejection plate is moved in the card ejecting direction by the tension spring, but the other end of the rod is moved away from the second bent point for engagement with the cam groove at a third bent point thereof (position corresponding to the center of an upper portion of the heart-like shape), so that the motion of the ejection plate in the card ejecting direction is stopped. At this time, the card is urged by the pressing portion of the ejection plate, and is stopped after being slightly moved in the card ejecting direction.

In this state, when the card is urged again deeply into the accommodating space, the motion of the card is transmitted to the rod via the ejection plate, whereby the other end of the rod is moved away from the third bent point, and is brought into abutment with a fourth bent point of the cam groove (position corresponding to an upper left end of the heart-like shape), so that even if the card is pushed further, the card is not moved. At this time, the ejection plate is positioned at the rearmost part of the accommodating space.

When the user's hand is taken off the card, the other end of the rod is moved away from the fourth bent point such that it can move to the first bent point within the cam groove, and hence the ejection plate is moved in the card ejecting direction by the tension spring. At this time, the card is urged by the pressing portion of the ejection plate, and is moved in the card ejecting direction.

When the ejection plate is moved by a predetermined distance in the card ejecting direction, the pressing portion of the ejection plate is brought into abutment with part of the housing, and is stopped. At this time, although an inertia force acts on the card, and the card is about to jump out of the accommodating space, the card is stopped together with the ejection plate with part thereof protruded from the accommodating space since the engaging portion of the ejection plate is engaged with the cutout of the card. As a result, the card is prevented from jumping out of the accommodating space during ejection of the card.

The card is locked by the engaging portion of the ejection plate by so-called half-locking which enables the card to be unlocked by applying a force in the card ejecting direction to the card. Therefore, if the part of the card protruded from the accommodating space is pulled, the card can be drawn out from the accommodating space.

In the above-described connector, when the accommodating space has no card inserted therein, the engaging portion of the ejection plate is positioned in the vicinity of an opening of the accommodating space.

Therefore, when a card is inserted into the accommodating space obliquely with respect to the card inserting/ejecting direction, a corner of a front end of the card is brought into contact with the engaging portion, which can cause damage of the engaging portion.

SUMMARY OF THE INVENTION

The present invention has been made in view of these circumstances, and an object thereof is to provide a connector which is capable of preventing an engaging portion of an ejection mechanism from being damaged even when a card-type electronic component is inserted obliquely with respect to a card inserting/ejecting direction.

To attain the above object, the present invention provides a connector comprising a housing that has an accommodating portion for accommodating a card-type electronic component, a cover that is mounted on the housing in a manner covering the accommodating portion, an ejection mechanism that causes the card-type electronic component to be ejected from the accommodating portion, the ejection mechanism having a locking portion that engages with the card-type electronic component such that part of the card-type electronic component remains within the accommodating portion when causing the card-type electronic component to be ejected, and a guide that guides a front end of the card-type electronic component in a card inserting/ejecting direction when the card-type electronic component is inserted into the accommodating portion obliquely with respect to the card inserting/ejecting direction.

With the arrangement of the connector according to the present invention, when the card-type electronic component is inserted obliquely with respect to the card inserting/ejecting direction, the guide prevents the card-type electronic component from being inserted obliquely by any more than a predetermined amount when guiding the card-type electronic component in the card inserting/ejecting direction. As a result, the locking portion is prevented from being damaged by the front end of the card-type electronic component, and the card-type electronic component is accurately accommodated in the accommodating portion of the housing.

According to the present invention, even when the card-type electronic component is inserted obliquely with respect to the card inserting/ejecting direction, the locking portion of the ejection mechanism is prevented from being damaged.

Preferably, the guide has a plate-like shape and extends in the card inserting/ejecting direction, the guide being disposed above the locking portion, and at least part of the locking portion is capable of moving below the guide.

Preferably, the guide is provided on the cover.

Preferably, the guide is provided in the housing.

Preferably, the guide is provided both in the housing and on the cover.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing a preferred embodiment thereof.

Figure 1:
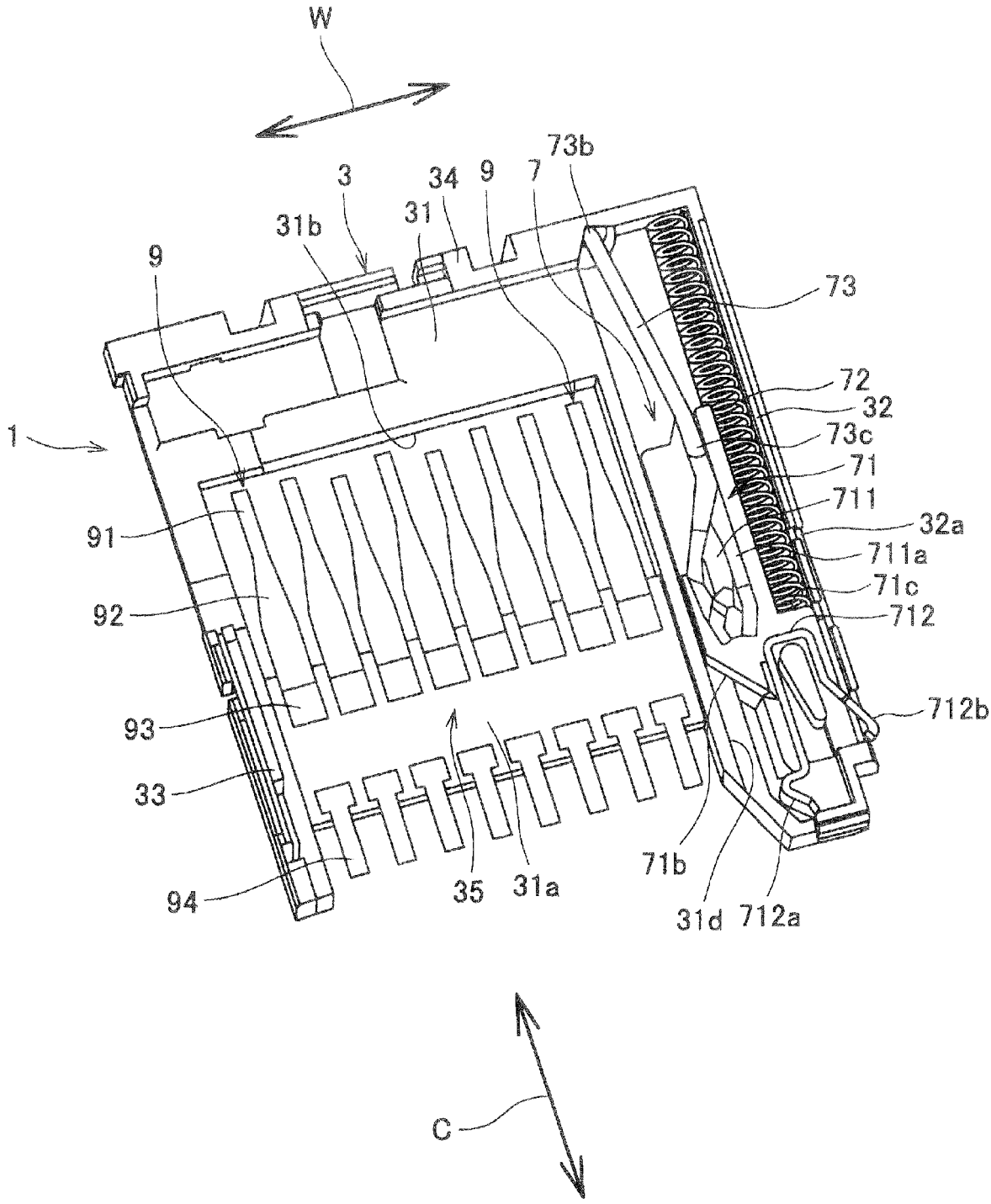
FIG. 1 is a perspective view of a card connector according to an embodiment of the present invention, in a state having a cover removed therefrom.
Figure 2:
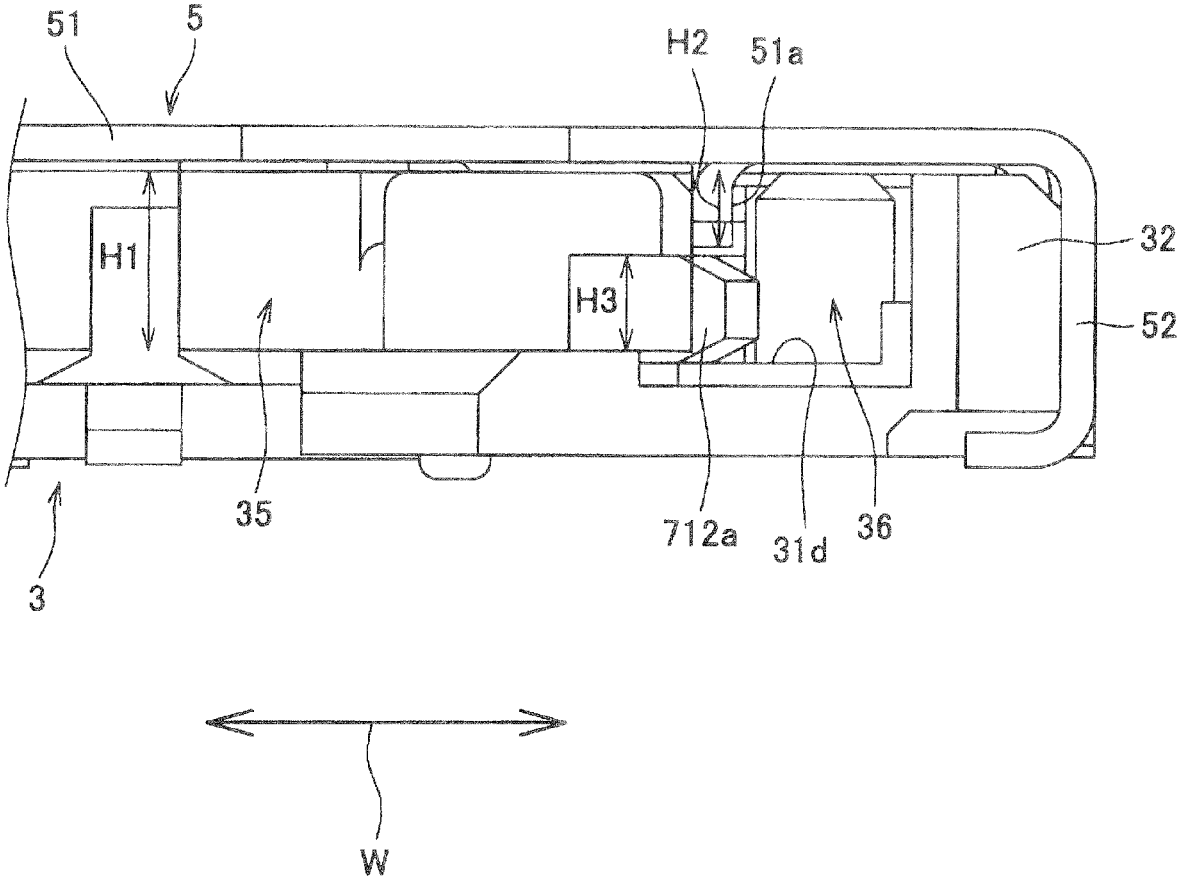
FIG. 2 is a front view of the FIG. 1 card connector in a state having the cover mounted thereon.
Figure 3:
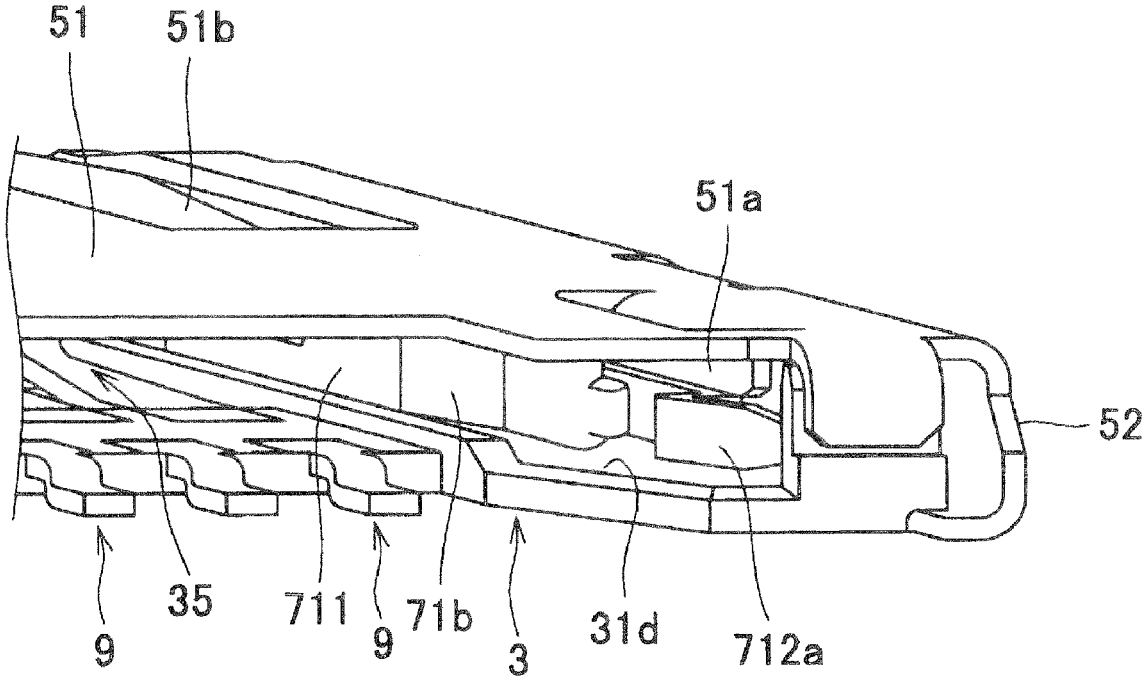
FIG. 3 is a perspective view of one corner of the FIG. 1 card connector.

As shown in FIGS. 1 to 3, a card connector (connector) 1 is comprised of a housing 3, a cover 5, and an ejection mechanism 7. The card connector 1 is provided for a memory card (card-type electronic component) 20, and is mounted on a printed circuit board, not shown.

The housing 3 includes a housing body 31, side wall portions 32 and 33, and a rear wall portion 34. The housing 3 is made of a resin. The housing body 31 has a generally plate-like shape, and includes a contact fixing portion 31*a* and a window hole 31*b*. The contact fixing portion 31*a* is located at a front portion of the housing body 31. The window hole 31*b* is formed adjacent to the contact fixing portion 31*a*, and is located in an approximately central portion of the housing body 31. The housing body 31 has one side portion formed with a recess 31*d*. The recess 31*d* extends in a card inserting/ejecting direction C, referred to hereinafter (see FIG. 5). The side wall portions 32 and 33 are continuous with side edges of the housing body 31, respectively. The rear wall portion 34 is continuous with a rear edge of the housing body 31. The housing body 31, the side wall portions 32 and 33, and the rear wall portion 34 form a card accommodating portion (accommodating portion) 35. The card accommodating portion 35 accommodates the memory card 20 such that the memory card 20 can be inserted into and ejected from the card accommodating portion 35 in the card inserting/ejecting direction C (direction parallel to the direction of the length of the side wall portions 32 and 33). The memory card 20 has one side surface formed with an abutment portion 20*a* and a recess 20*b* (see FIG. 4). The memory card 20 is guided in the card inserting/ejecting direction C by the side wall portion 33 and an ejection bar 71, referred to hereinafter.

The housing 3 holds a plurality of contacts 9. The contacts 9 are arranged at equally-spaced intervals in the direction W of the width of the housing 3. As shown in FIG. 1, each contact 9 has a generally plate-like shape, and extends in the card inserting/ejecting direction C. The contact 9 includes a contact portion 91, a spring portion 92, a fixed portion 93, and a terminal portion 94. The contact portion 91 is brought into contact with a terminal section, not shown, of the memory card 20. The spring portion 92 is continuous with the contact portion 91, for pushing the contact portion 91 against the terminal section of the memory card 20. The fixed portion 93 is continuous with the spring portion 92, and is fixed to the contact fixing portion 31*a*. The terminal portion 94 is connected to the fixed portion 93, and protrudes forward from the contact fixing portion 31*a*.

Figure 6A:
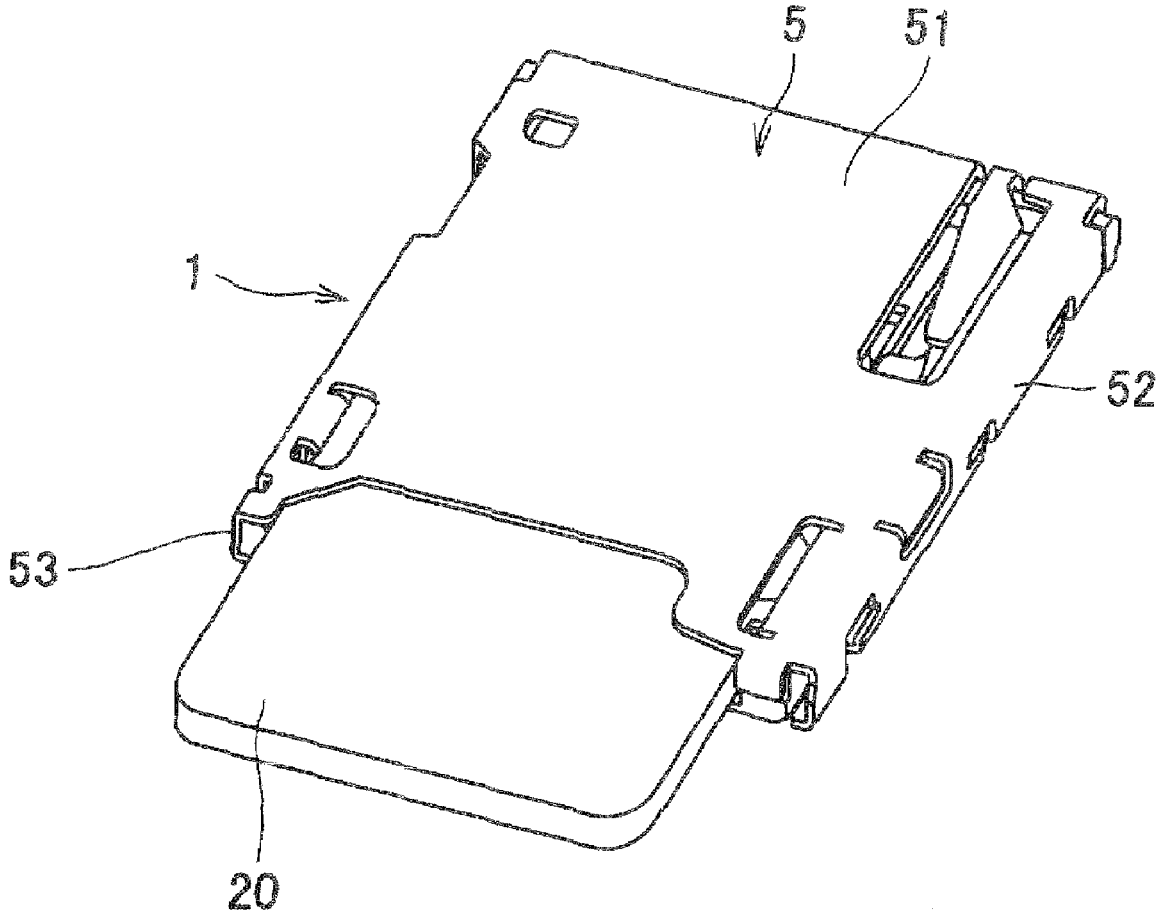
FIG. 6A is a perspective view of the card connector and the memory card in a state in which more than a half of the memory card is inserted into the connector.

The cover 5 includes a cover body 51, and side wall portions 52 and 53 (see FIG. 6A). The cover 5 is mounted on the housing 3 in a manner covering the card accommodating portion 35. The cover body 51 has a generally plate-like shape, and includes a guide 51*a* and a pressing spring 51*b* (see FIG. 3). The cover 5 is formed by blanking and bending a metal plate. The guide 51*a* has a generally plate-like shape, and protrudes from a lower surface of the cover body 51 (a surface of the cover body 51 toward the housing 3) toward the housing body 31. The guide 51*a* extends in the card inserting/ejecting direction C, and protrudes toward a bottom surface of the recess 31*d*. The guide 51*a* has a height H2 approximately equal to a half of the height H1 of the card accommodating portion 35 (see FIG. 2). The pressing spring 51*b* has a generally tongue-like shape, and is formed by blanking. The pressing spring 51*b* extends in the card inserting/ejecting direction C. The pressing spring 51*b* forms part of the ejection mechanism 7, described hereinafter.

The ejection mechanism 7 is comprised of the ejection bar 71, a coil spring 72, a cam follower 73, and the pressing spring 51*b*. The ejection mechanism 7 is disposed in the recess 31*d*.

The ejection bar 71 includes a heart cam section 711, and a locking piece 712. The heart cam section 711 is made of a resin, and has a generally plate-like shape. The heart cam section 711 has an upper surface formed with a cam groove 711*a*. Further, the heart cam section 711 has one side surface formed with an abutment surface 71*b* which is brought into abutment with the abutment portion 20*a* of the memory card 20. The other side surface of the heart cam section 711 is formed with a cutout 71*c*. A lower portion of the heart cam section 711 is slidably fitted in the recess 31*d* of the housing body 31. This enables the heart cam section 711 to perform reciprocating motion in the card inserting/ejecting direction C.

The locking piece 712 is generally U-shaped, and includes a locking portion 712*a* and a contact portion 712*b*. The locking piece 712 is fitted to a front end of the heart cam section 711 such that it can perform a swinging motion in the direction W of the width. The locking piece 712 has a height H3 approximately equal to a half of the height H1 of the card accommodating portion 35 (see FIG. 2). As viewed from the guide 51*a*, the locking portion 712*a* of the locking piece 712 is located toward the window hole 31*b*, and portions of the locking piece 712 other than the locking portion 712*a* are located toward the side wall portion 32. As shown in FIG. 2, the locking portion 712*a* slides on the bottom surface of the recess 31*d*.

The coil spring 72 is a compression spring, and disposed on an ejection mechanism-disposing portion 31*c* of the housing body 31. Part of the coil spring 72 is accommodated in the cutout 71*c* of the ejection bar 71. The coil spring 72 has one end in contact with the rear wall portion 34 of the housing 3. The other end of the coil spring 72 is in contact with an end face of the heart cam section 711 defining the cutout 71*c* (part of the heart cam section 711 facing the cutout 71*c*). The coil spring 72 urges the ejection bar 71 in the ejecting direction of the memory card 20 (card ejecting direction).

The cam follower 73 is rod-shaped, and has opposite ends each bent into an L-shape. The cam follower 73 has one end pivotally connected to the rear wall portion 34 of the housing 3. The other end of the cam follower 73 is slidably inserted into the cam groove 711*a* of the heart cam section 711.

The pressing spring 51*b* of the cover 5 urges the other end of the cam follower 73 toward the cam groove 711*a*.

The operation of the ejection mechanism 7 of the card connector 1 according to the present embodiment is approximately the same as the operation of the above-described ejection mechanism of the card connector disclosed in Japanese Laid-Open Patent Publication (Kokai) No. 2003-217738 (hereinafter referred to as "the conventional card connector"). Different points between the card connector 1 according to the present embodiment and the conventional card connector are as follows: In the conventional card connector, the heart cam is fixed, and the rod moves together with the ejection plate, whereas in the card connector 1 according to the present embodiment, the heart cam section 711 moves in the card inserting/ejecting direction C as part of the ejection bar 71 while the cam follower 73 is fixed to the housing 3. Further, in the conventional card connector, a tension spring pulls the ejection plate, whereas in the card connector 1 according to the present embodiment, the coil spring 72 pushes the ejection bar 71. However, the relative motion of the other end of the rod with respect to the cam groove of the heart cam in the conventional card connector is the same as the relative motion of the other end of the cam follower 73 with respect to the cam groove 711*a* of the heart cam section 711 of the card connector 1 according to the present embodiment. Further, a direction in which the tension spring urges the ejection plate in the conventional card connector is the same as a direction in which the coil spring 72 urges the ejection bar 71 in the card connector 1 according to the present embodiment.

When the memory card 20 is not inserted into the card accommodating portion 35 of the housing 3, the ejection bar 71 is positioned at the foremost part of the card accommodating portion 35 (toward an opening of the housing 3). At this time, the other end of the cam follower 73 is positioned at a first bent point (position corresponding to a lower end of a heart-like shape) of the cam groove 711*a* of the heart cam section 711.

Referring to FIG. 6A, when the memory card 20 is inserted into the card accommodating portion 35 of the housing 3, the abutment portion 20*a* of the memory card 20 is brought into abutment with the abutment surface 71*b* of the ejection bar 71, and the locking portion 712*a* of the ejection bar 71 is engaged with the recess 20*b* of the memory card 20, whereafter the ejection bar 71 moves together with the memory card 20.

Figure 6B:
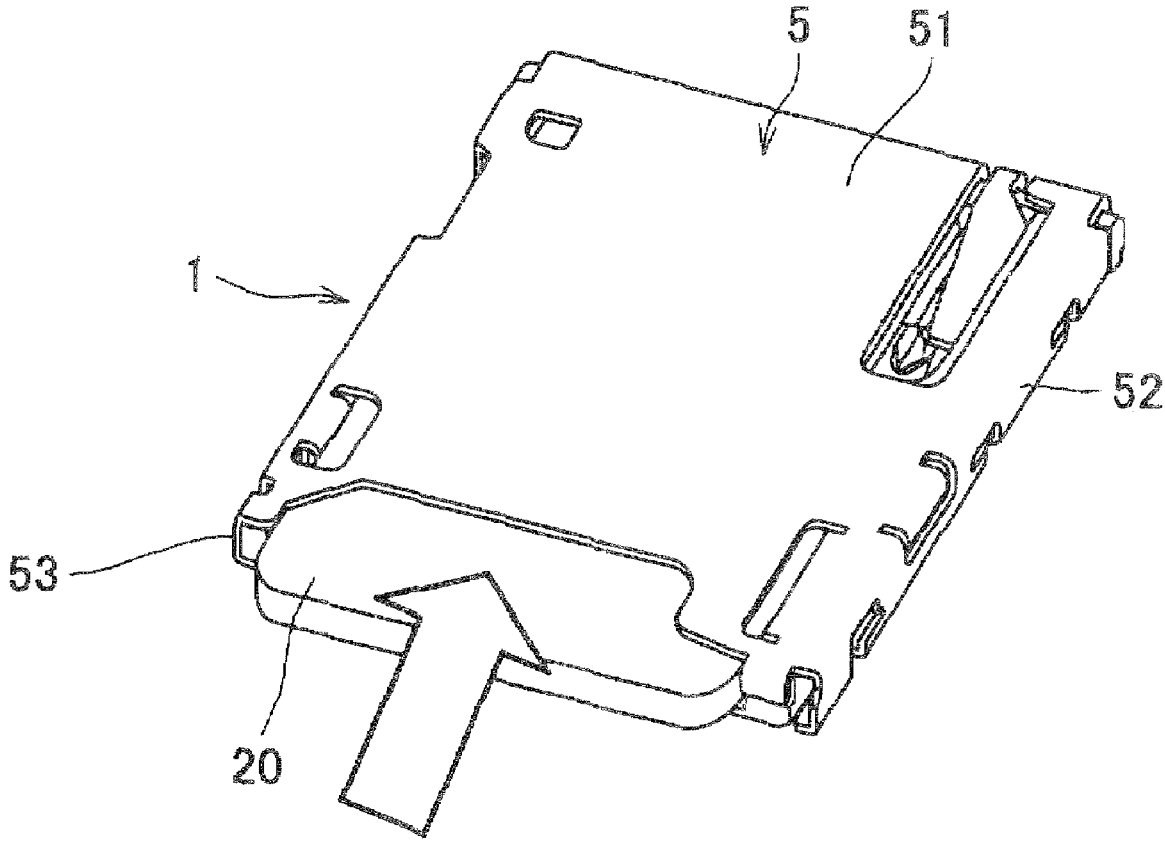
FIG. 6B is a perspective view of the card connector and the memory card in a state in which the memory card is pushed into the card connector until it is brought into abutment with the card connector.

When the memory card 20 advances by a predetermined distance in the card accommodating portion 35, the other end of the cam follower 73 is brought into abutment with a second bent point (position corresponding to a right upper end of the heart-like shape) of the cam groove 711*a*. At this time, as shown in FIG. 6B, the memory card 20 is not moved even when the memory card 20 is pushed, and the ejection bar 71 is at the rearmost part of the card accommodating portion 35.

Figure 6C:
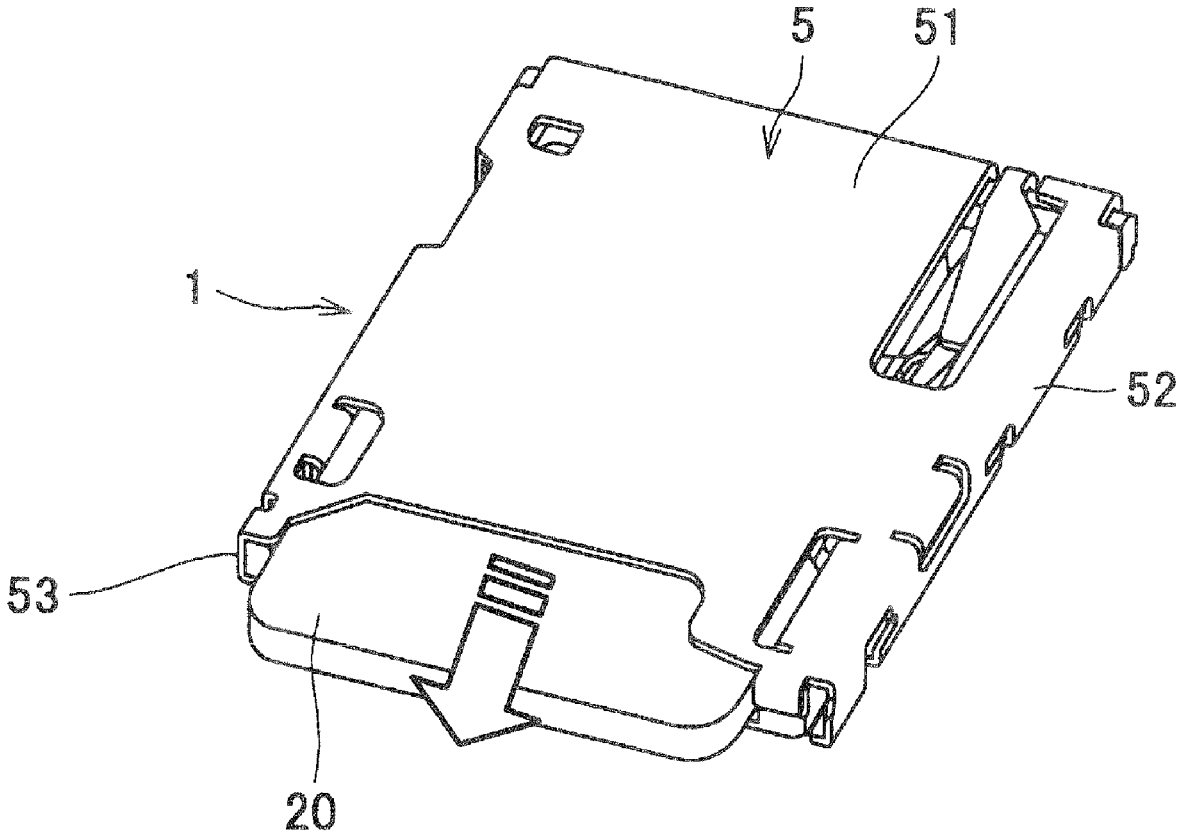
FIG. 6C is a perspective view of the card connector and the memory card in a state in which the memory card is locked to the card connector.

When a user's hand is taken off the memory card 20, the ejection bar 71 is moved in the card ejecting direction by the coil spring 72, but the other end of the cam follower 73 is moved away from the second bent point for engagement with the cam groove 711*a* at a third bent point thereof (position corresponding to the center of an upper portion of the heart-like shape), so that the motion of the ejection bar 71 in the card ejecting direction is stopped. Further, the memory card 20 is urged by the abutment surface 71*b* of the ejection bar 71, and is stopped after being slightly moved in the card ejecting direction, as shown in FIG. 6C. At this time, the terminal sections of the memory card 20 is brought into contact with the associated contact portions 91 of the contact 9, whereby the memory card 20 is electrically connected to the printed circuit board via the card connector 1.

Figure 6D:
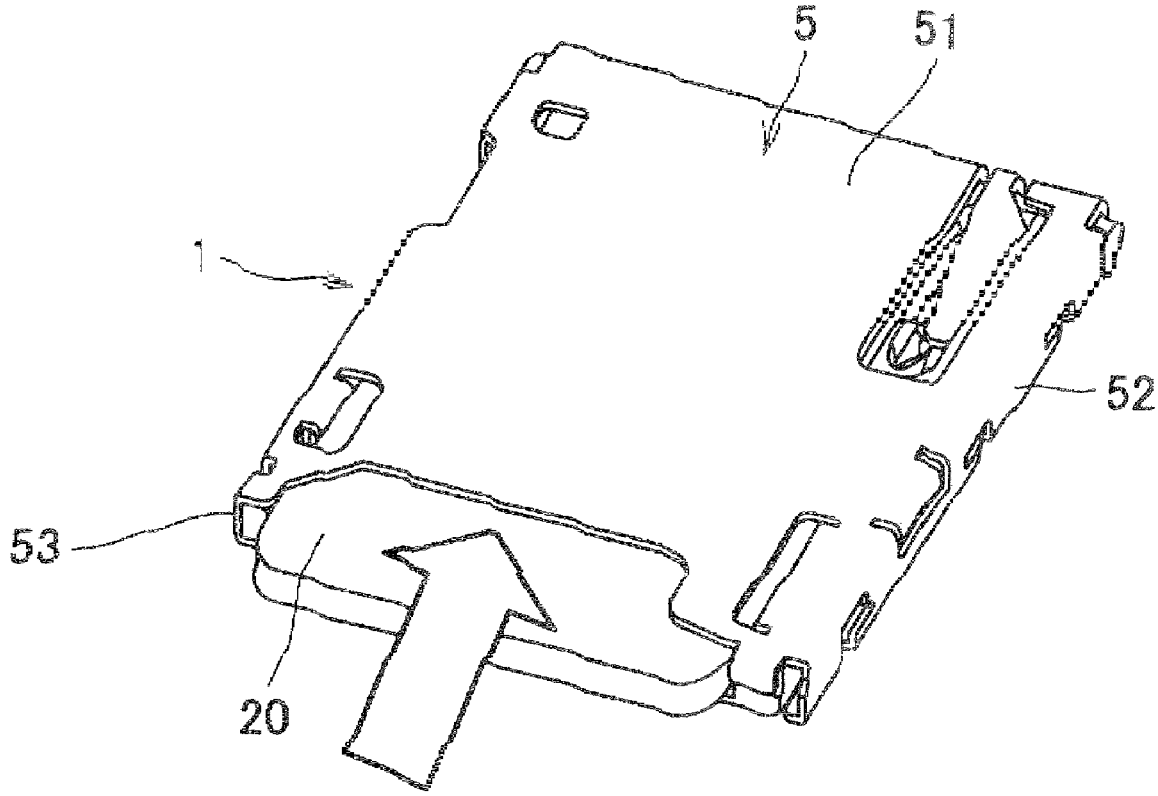
FIG. 6D is a perspective view of the card connector and the memory card in a state in which the memory card is pushed into the card connector from the state shown in FIG. 6C.

Referring to FIG. 6D, when the memory card 20 is urged again deeply into the card accommodating portion 35, the motion of the memory card 20 is transmitted to the ejection bar 71 via the abutment portion 20*a*, whereby the ejection bar 71 is moved deeply into an ejection mechanism-accommodating portion 36. Along with the motion of the ejection bar 71, the other end of the cam follower 73 is moved away from the third bent point, and is brought into abutment with a fourth bent point of the cam groove 711*a* (position corresponding to an upper left end of the heart-like shape), so that even if the memory card 20 is pushed further, the memory card 20 is not moved. At this time, the ejection bar 71 is positioned at the rearmost part of the card accommodating portion 35.

When the user's hand is taken off the memory card 20, the other end of the cam follower 73 is moved away from the fourth bent point such that it can move to the first bent point within the cam groove 711*a*, and hence the ejection bar 71 is moved in the card ejecting direction by the coil spring 72. At this time, the memory card 20 is urged by the abutment surface 71*b* of the ejection bar 71, and hence is moved in the card ejecting direction.

When the ejection bar 71 is moved by a predetermined distance in the card ejecting direction, it is brought into abutment with part of the housing 3, and is stopped. At this time, although an inertia force acts on the memory card 20, and the memory card 20 is about to jump out of the card accommodating portion 35, the memory card 20 is stopped together with the ejection bar 71 with part thereof protruded from the card accommodating portion 35 since the locking portion 712*a* of the ejection bar 71 is engaged with the recess 20*b* of the memory card 20. As a result, the memory card 20 is prevented from jumping out of the card accommodating portion 35 during ejection of the memory card 20.

The locking portion 712*a* of the ejection bar 71 half-locks the memory card 20, so that if the part of the memory card 20 protruded from the card accommodating portion 35 is pulled, the memory card 20 can be drawn out from the card accommodating portion 35.

When the memory card 20 is inserted into the card accommodating portion 35 by a predetermined amount, and is electrically connected to the printed circuit board via the card connector 1, the contact portion 712*b* of the locking piece 712 is in contact with the side wall portion 32 of the housing 3, and the distance between the locking portion 712*a* and the contact portion 712*b* is reduced. As a result, the locking piece 712 is strongly compressed in the direction W of the width of the housing 3, and the locking portion 712*a* is brought into strong contact with the recess 20*b* of the memory card 20 such that the memory card 20 cannot be removed easily from the card connector 1.

When the memory card 20 is not inserted into the card accommodating portion 35 by the predetermined amount, the contact portion 712*b* of the locking piece 712 is within a cutout 32*a* in the side wall portion 32 of the housing 3, and kept from contact with the side wall portion 32. Therefore, the locking piece 712 is hardly compressed in the direction W of the width of the housing 3, and the locking portion 712*a* is brought into contact with the recess 20*b* of the memory card 20 with an appropriate force.

Figure 4:
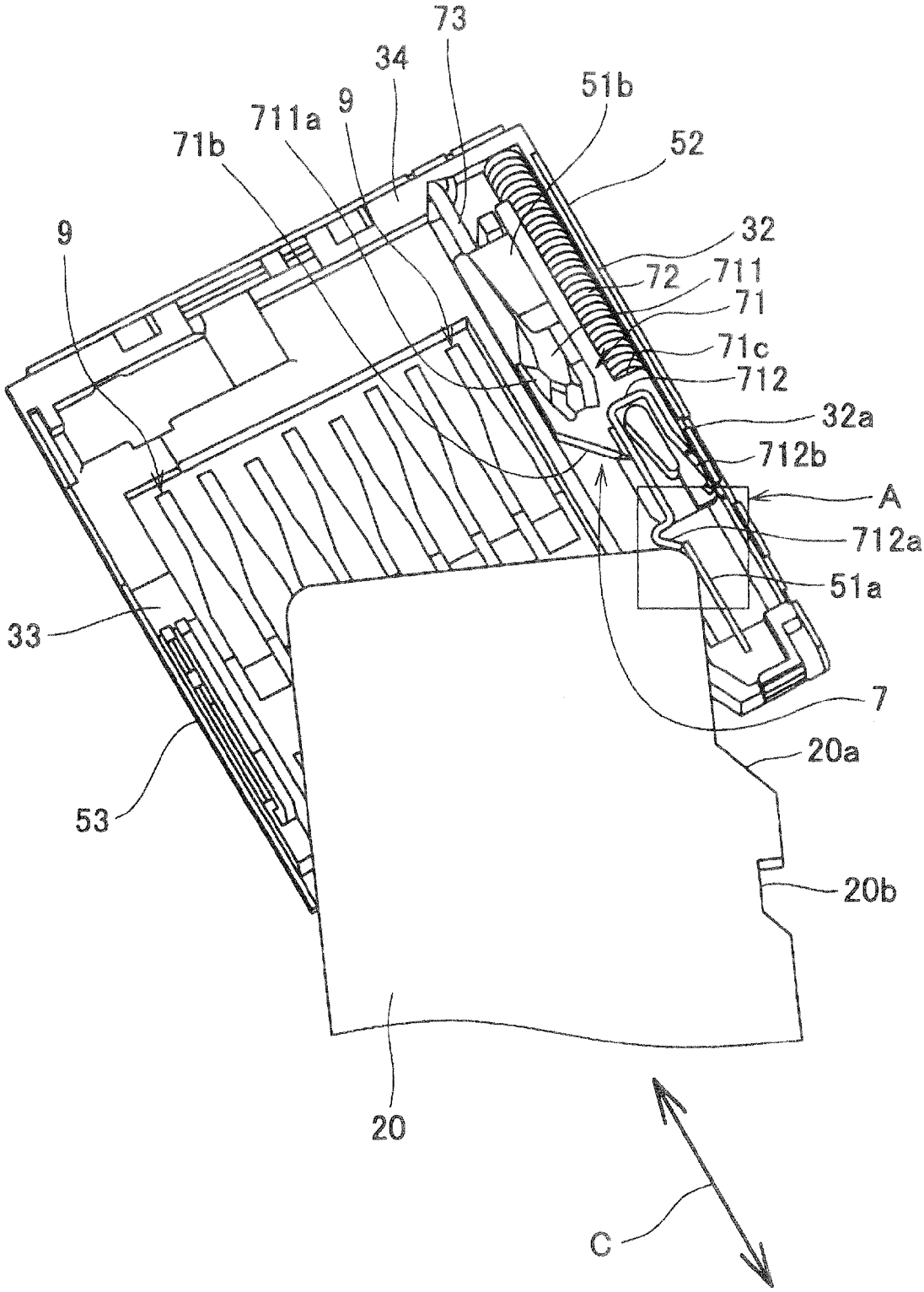
FIG. 4 is a perspective view of the FIG. 1 card connector and a memory card in a state in which the memory card is inserted obliquely into the card connector.
Figure 5:
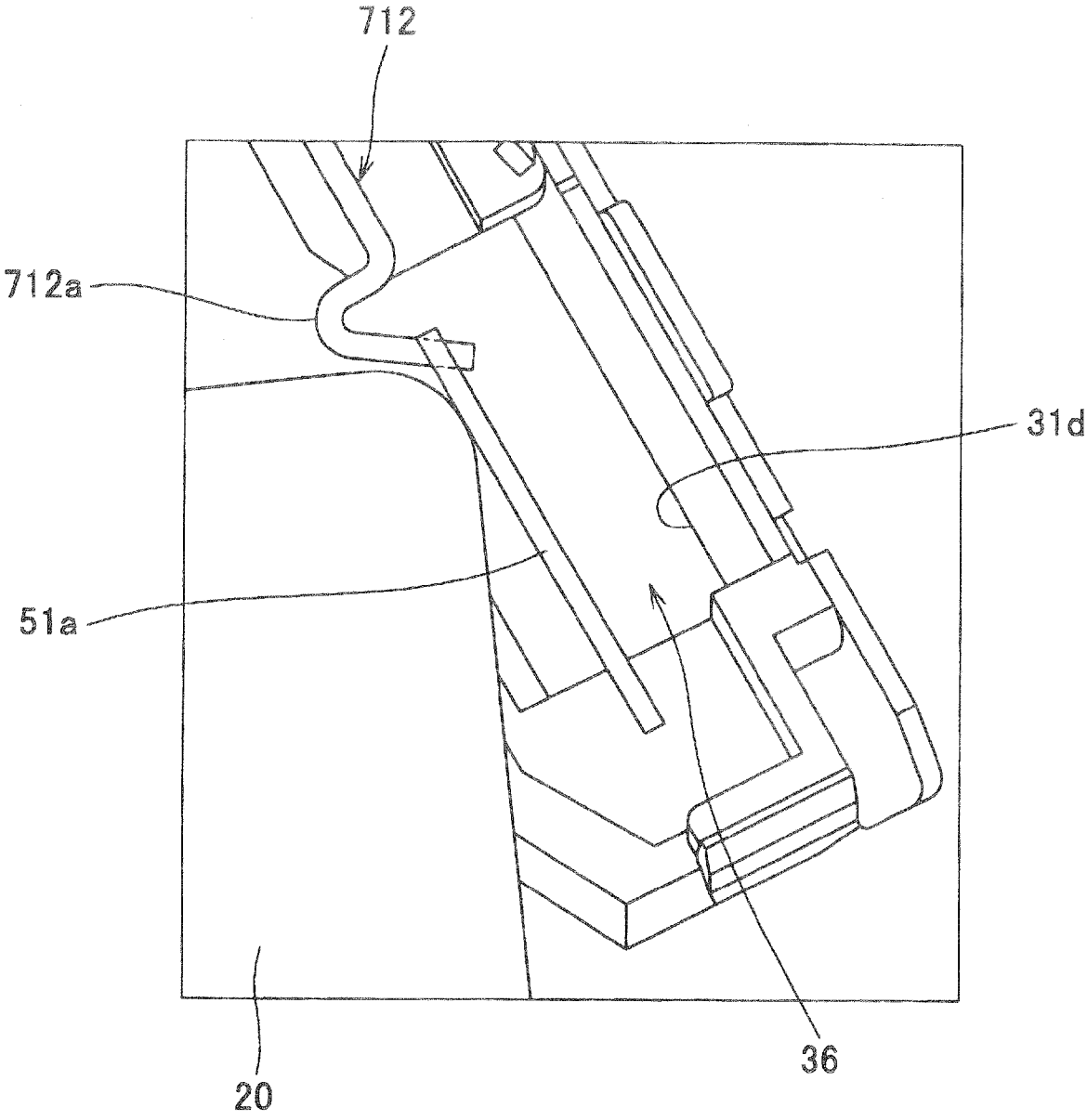
FIG. 5 is an enlarged view of part A in FIG. 4.

FIGS. 4 and 5 show the position of the ejection bar 71 located when the memory card 20 is inserted obliquely into the card accommodating portion 35. If the memory card 20 is inserted obliquely with respect to the card inserting/ejecting direction C, a corner of a front end of the memory card 20 is brought into contact with the locking portion 712*a*, but the guide 51*a* prevents the memory card 20 from being inserted obliquely by any more than a predetermined amount when guiding the memory card 20 in the card inserting/ejecting direction C. As a result, the locking portion 712*a* is prevented from being damaged by the front end of the memory card 20, and the memory card 20 is accurately accommodated in the card accommodating portion 35 of the housing 3.

As described hereinabove, according to the connector of the present embodiment, even if the memory card 20 is inserted into the card accommodating portion 35 obliquely with respect to the card inserting/ejecting direction C, the locking portion 712*a* is prevented from being damaged by the front end of the memory card 20, and the memory card 20 is accurately accommodated in the card accommodating portion 35 of the housing 3.

Further, since the guide 51*a* has a plate-like shape, it can be formed easily.

It should be noted that although in the above-described embodiment, the guide 51*a* is disposed in the cover 5, this is not limitative, but the guide may be provided in the housing 3 or in each of the housing 3 and the cover 5. When the guide is provided in the housing 3, the locking portion 712*a* is configured to be disposed toward the cover 5, and the guide is configured to protrude from a bottom surface of the housing 3. When the guide is formed in each of the housing 3 and the cover 5, the locking portion is configured to be disposed at an intermediate location (intermediate location in the direction of the height of the housing) between the housing 3 and the cover 5, and a first guide is protruded upward from the bottom surface of the housing 3 while a second guide is protruded downward from the lower surface of the cover 5.

Further, although in the above-described embodiment, the guide 51*a* has a plate-like shape, the guide 51*a* is not required to have a plate-like shape. The shape of the guide is not limited to the plate-like shape, but the guide is only required to have a surface for guiding the memory card 20 in the card inserting/ejecting direction C when the memory card 20 is inserted into the card accommodating portion 35 obliquely with respect to the card inserting/ejecting direction C.

It should be noted that although the above-described embodiment is a connector for a memory card, the present invention may be applied to a connector for a card-type electronic component other than the memory card.

It is further understood by those skilled in the art that the foregoing are the preferred embodiments of the present invention, and that various changes and modification may be made thereto without departing from the spirit and scope thereof.

What is claimed is:

1. A connector comprising:

a housing that has an accommodating portion for accommodating a card-type electronic component;

a cover that is mounted on said housing in a manner covering said accommodating portion;

an ejection mechanism that causes the card-type electronic component to be ejected from said accommodating portion, said ejection mechanism having a locking portion that engages with the card-type electronic component such that part of the card-type electronic component remains within said accommodating portion when causing the card-type electronic component to be ejected; and a guide that guides a front end of the card-type electronic component in a card inserting/ejecting direction when the card-type electronic component is inserted into said accommodating portion obliquely with respect to the card inserting/ejecting direction;

wherein said guide has a plate-like shape and extends in the card inserting/ejecting direction, said guide is disposed above said locking portion, and at least part of said locking portion is capable of moving below said guide.

2. A connector as claimed in claim 1, wherein said guide is provided on said cover.

* * * * *

UNITED STATES PATENT AND TRADEMARK OFFICE

CERTIFICATE OF CORRECTION

PATENT NO. : 7,658,638 B2
APPLICATION NO. : 12/265776
DATED : February 9, 2010
INVENTOR(S) : Joe Motojima It is certified that error appears in the above-identified patent and that said Letters Patent is hereby corrected as shown below:

Title Page, column 1, below (65) Prior Publication Data, insert as follows:

--(30) Foreign Application Priority Data

Nov. 30, 2007 (JP) ..... 2007-311263--.

Signed and Sealed this

Thirty-first Day of August, 2010

David J. Kappos

David J. Kappos
*Director of the United States Patent and Trademark Office*